United States Patent [19]

Seger

[11] 4,071,586

[45] Jan. 31, 1978

[54] VARIABLE ORIFICE DESUPERHEATER

[75] Inventor: Fritz O. Seger, Fairview, Pa.

[73] Assignee: Copes-Vulcan, Inc., Lake City, Pa.

[21] Appl. No.: 735,279

[22] Filed: Oct. 26, 1976

[51] Int. Cl.[2] ..... B01F 3/04

[52] U.S. Cl. ..... 261/62; 122/487; 261/64 B; 261/78 A; 261/118; 261/DIG. 13; 261/DIG. 55

[58] Field of Search ..... 261/62, 64 R, 64 B, 261/78 A, 118, 76, DIG. 10, DIG. 13, DIG. 32, DIG. 33, DIG. 76, DIG. 55, 115–117; 122/487, 479 R

[56] References Cited

U.S. PATENT DOCUMENTS

| | | | |
|---|---|---|---|
| 1,092,279 | 4/1914 | Martin et al. | 261/DIG. 55 |
| 1,257,494 | 2/1918 | Krohn | 261/62 |
| 1,311,088 | 7/1919 | Ong | 261/DIG. 55 |
| 1,932,764 | 10/1933 | Benjamin et al. | 261/62 X |
| 2,355,458 | 8/1944 | Mastenbrook | 261/DIG. 13 |
| 2,391,663 | 12/1945 | Weber et al. | 261/78 A |
| 2,945,685 | 7/1960 | Bowlus | 261/DIG. 13 |
| 3,981,946 | 9/1976 | Soya et al. | 261/DIG. 13 |
| 4,011,287 | 3/1977 | Marley | 261/DIG. 13 |

FOREIGN PATENT DOCUMENTS

| | | | |
|---|---|---|---|
| 100,552 | 8/1923 | Switzerland | 261/62 |

*Primary Examiner*—Tim R. Miles

*Assistant Examiner*—Richard L. Chiesa

*Attorney, Agent, or Firm*—Mandeville and Schweitzer

[57] ABSTRACT

An automatically regulated variable orifice desuperheater valve is disclosed which includes improved constructional features providing for a more compact installation then heretofore, one which is more reliable in operation and which is at the same time more economical to construct. The desuperheater unit has a welded-closed housing, which includes a concentrically mounted valve guide structure. The lower portion of the desuperheater valve housing structure is arranged so that, after the unit is welded closed, with the valve guide structure contained therein, the valve element may be inserted into the housing from the bottom or inlet opening, followed by a shouldered sleeve which functions as the valve seat. The sleeve is seated against a facing shoulder in the inlet opening of the valve housing, and is secured against such shoulder by appropriate means such as welding. The housing surrounding the valve and valve guide is of minimum height, sufficient to accommodate the flow of steam and injected water around the valve and valve guide, and quickly converges the flow of materials back to the diameter of the main piping systems. The construction of the new device is more rugged and compact than previous designs, significantly less costly to construct, and at the same time superior in performance.

11 Claims, 3 Drawing Figures

VARIABLE ORIFICE DESUPERHEATER

BACKGROUND AND SUMMARY OF THE INVENTION

In the operation of steam and boiler systems, it is often the case that steam is available for use at a temperature much greater than is necessary or desired for a particular end use. In such cases, it is customary to utilize a so-called desuperheater, by which water is injected into a flowing stream of high temperature steam and mixed therewith. Ideally, the injected water itself almost immediately turns to steam, serving to convert the incoming, high temperature steam to a somewhat larger volume of steam at a somewhat lower temperature, i.e., with less superheat.

An earlier patent granted to Sanford S. Bowlus, U.S. Pat. No. 2,945,685, discloses an advantageous form of automatic desuperheater device, known as a variable orifice desuperheater. In the device of the Bowlus patent, incoming steam, traveling vertically upward through a desuperheater housing inlet, was arranged to lift against gravity a weighted valve element. The extent to which the valve element opened is automatically a function of the volume and velocity of the incoming steam. Surrounding the weighted valve element is a small orifice communicating with a source of desuperheating water. When steam is flowing through the system the weighted valve is lifted, resulting in a high velocity flow of the steam around the valve and an atomizing action of the steam on the surrounding water. The arrangement is such that, relatively independently of the volume of steam flow within reasonable limits, there will be an effective atomizing action of the steam upon the water. The amount of water injected into the desuperheater and combined with the incoming steam is controlled independently, as a function of steam temperature.

In basic principle, the variable orifice desuperheater of the Bowlus U.S. Pat. No. 2,945,685 is highly effective in operation. Thus, the present invention seeks to utilize the significant operative principles of the earlier Bowlus patent, while at the same time incorporating such principles into a substantially improved physical embodiment, which is more compact and rugged than prior devices and at the same time less costly to produce. These advantages are achieved without sacrifice of performance and, indeed, with improvement in performance in certain respects.

In accordance with one aspect of the invention, an improved variable orifice desuperheater is provided which includes a plug-type valve slideably guided within the desuperheater housing (a feature in itself previously known) which cooperates with a valve housing and valve seat structure in a unique and advantageous way to simplify and reduce the cost of construction of the unit. In accordance with this feature, the housing of the desuperheater unit is constructed with an internal, cylindrical valve guide, which is welded or otherwise secured in the interior of the housing. The housing is then welded closed, except that the opening at the inlet or lower end thereof is sufficiently large to receive the cylindrical valve plug and a sleeve-like member forming the valve seat. After the main housing has been welded closed, the valve and valve seat elements are slideably inserted through the bottom or inlet opening, with the valve seat being secured in position in the inlet passage.

As a more specific aspect of the invention, the inlet passage of the housing, and the sleeve-like valve seat element, are formed with mutually engaging shoulders, against which the sleeve-like element is seated for precise positioning of the valve seat relative to the water injection orifice area of the valve. This assures that, upon final assembly of the valve and valve seat elements, the working components of the desuperheater valve will be precisely positioned within the housing.

In accordance with another advantageous feature of the invention, the so-called mixing chamber, heretofore thought to be necessary to be provided within the desuperheater, is eliminated altogether, and the enlarged region of the desuperheater housing is reduced to a practical minimum of height. In this respect, the housing is necessarily enlarged in diameter, in relation to the diameter of the flow piping, in order to accommodate the flow of steam and injected water around the valve and valve guide area. Heretofore, it has been thought necessary to extend the enlarged diameter housing for a substantial distance beyond the valve area, before reconverging the flow back into the regular piping system. Pursuant to the present invention, however, the housing is brought back to normal diameter, and the flow of desuperheated steam is converged back to the diameter of the basic piping system almost immediately after the steam flow passes the upper end of the valve structure. This enables significant structural improvement in the overall unit, as well as a great savings in material and construction time. At the same time, the necessary mixing action is enabled to occur, partly within the minimum size housing and the balance within the piping system itself.

For a more complete understanding of the above and other features and advantages of the invention, reference should be made to the following detailed description of a preferred embodiment and to the accompanying drawings.

DESCRIPTION OF A PREFERRED EMBODIMENT OF THE INVENTION

Figure 1:
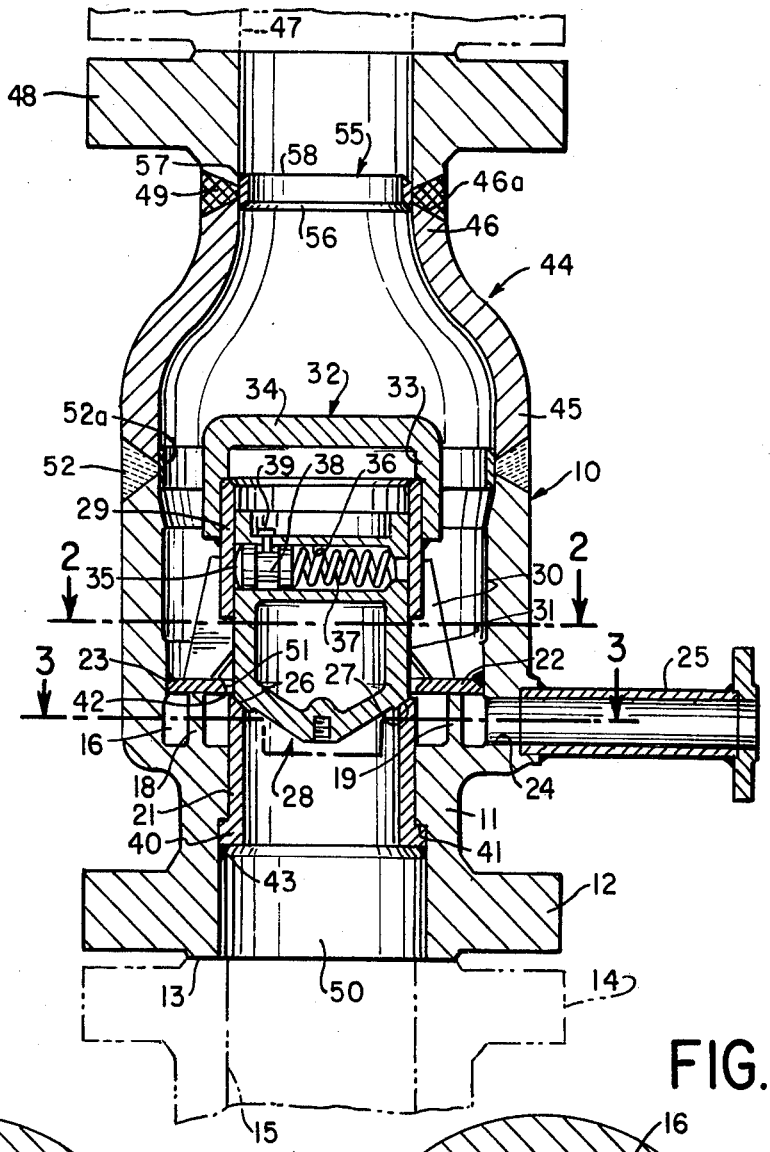
FIG. 1 is a longitudinal cross sectional view of a variable orifice desuperheater valve unit incorporating the features of the invention.

Referring now to the drawing, the reference numeral 10 designates generally a lower housing body of the desuperheater unit. In general, the lower housing body may be of cast steel construction, suitable for withstanding relatively high temperature, high pressure steam service. At its lower end, the lower housing 10, which may be referred to for convenience as the valve housing, has a short neck 11 terminating in a bottom flange 12 and sealing face 13. The flange 12 is provided with suitably spaced openings for the reception of clamping bolts for securement to an adjacent flange 14 of a steam line 15, in accordance with known procedures.

In the lower portion of the valve housing 10, directly above the neck 11, is formed a water inlet chamber 16, which is defined by the inner wall 17 of the housing, a pair of baffle members 18, 19 and an inner wall 20 formed by an internal sleeve 21 to be further described. An orifice plate 22 is welded at 23 to the housing wall 17 and serves to close off the upper end of the water inlet chamber 16. The water chamber inlet 16 is connected through a passage 24 to an inlet pipe 25 adapted for connection to a source of water. Pursuant to the beforementioned Bowlus U.S. Pat. No. 2,945,685, the flow of water into the chamber 16 is controlable by an external valve (not shown) which is appropriately regulated, as by the condition of the steam downstream of the desuperheater unit.

In accordance with previously known modifications of the Bowlus patent, the upper end of the sleeve 21 forms a conical valve seat 26 for cooperation with a similar conical valve surface 27 formed on a generally cylindrical valve plug 28. The valve plug 28 is slidably received in a cylindrical valve guide sleeve 29 rigidly supported within the housing 10 by means of a plurality of radially disposed ribs 30, which are welded to the orifice plate 22. The lower portions 31 of the guide ribs may also provide guide surfaces for support of the lower portion of the valve plug 28, as reflected in FIGS. 1 and 2. Welded or otherwise secured to the upper end of the guide sleeve 29 is an abutment stop 32, typically in the form of an inverted U-shaped metal strap, the depending legs 33 of which extend downward to the sleeve 29, and the upper leg 34 of which extends horizontally across the top of the guide sleeve, serving to engage and limit the upward movement of the valve member 28.

Due to the highly turbulent nature of the steam passing through the valve unit, excess motion of the valve member 28 is reduced by a friction plunger 35, which is received within a transverse recess 36 in the valve plug. A compressible spring 37 urges the plunger outward against the inside wall of the guide sleeve, minimizing any "rattling" of the plug within the sleeve. To facilitate assembly and disassembly of the unit, the friction plunger 35 is provided with an annular groove 38 arranged to receive a stop pin 39. The stop pin is inserted for assembling and disassembling operations, but is removed when the unit is placed in service.

Figure 2:
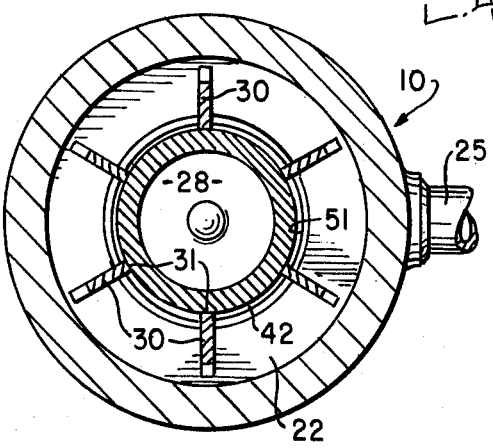
FIGS. 2 and 3 are transverse cross sectional views as taken generally along lines 2—2 and 3—3 respectively of FIG. 1.
Figure 3:
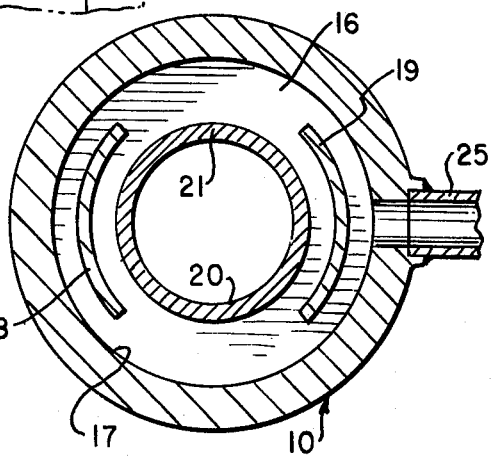

As is reflected particularly in FIG. 1, an annular orifice of predetermined dimensions is formed between the upper edge of the valve seat 21 and the inner edge of the orifice plate 22. The size of this orifice is determined in part by the diameter of the central opening or orifice in the plate 22 and in part by the vertical positioning of the sleeve 21. To this end, and in accordance with one of the features of the invention, the valve seat sleeve 21 is provided with an angular flange 40 which seats against a downwardly facing internal shoulder 41 within the neck area 11 of the housing body 10. This serves to precisely position the sleeve 21 within the housing body and establishes the desired annular water injection orifice 42. Appropriate arrangements are provided for locking the valve seat sleeve 21 into the housing. In the illustrated form of the device, the sleeve is secured by an annular weld 43 at the lower end of the sleeve.

As shown in FIG. 1, the desuperheater unit includes an upper housing body 44 secured to the valve housing 10. The lower extremity 45 of the upper housing constitutes an extension of the valve housing 10. However, a short distance above the valve structure, the housing 44 converges into a neck portion 46 of a diameter corresponding to that of the downstream piping 47.

In the illustrated form of the invention, the upper housing 44 is formed with a beveled upper end **46*a* for welded attachment to the main steam line where desired. In many cases, however, it is desired to provide a flange 48, to be secured to the downstream piping by clamping bolts (not shown) and in such cases a standard flange section may be welded at 49 to the neck 46 of the upper housing section 44**.

In accordance with the teachings of the beforementioned Bowlus Patent, superheated steam enters the desuperheater unit, flowing upwardly through the entrance passage 50. The pressure of the incoming steam causes the valve plug 28 to be lifted slightly off of its seat 26, allowing the steam to pass through the annular, conical orifice thus formed. The steam entering the interior of the desuperheater housing passes over the annular water ejection orifice 42 and through an annular orifice 51 formed between the valve plug 28 and the orifice plate 22. In accordance with known principles of the Bowlus Patent, the valve plug 28, being seated by gravity, will lift off its valve seat as far as necessary to establish a pressure drop sufficient to balance the weight of the valve plug. Thus, regardless of the amount of steam flowing through the system, over its normal operating range, a substantially constant pressure drop will be developed across the valve opening. The steam flowing through the valve opening does so at relatively high velocity, achieving a high efficiency atomization of water, which is simultaneously being discharged into the flow path of the steam through the annular orifice 42. The amount of water so discharged is controlled externally of the desuperheater unit. The described arrangement provides for a high efficiency mixing of steam and ejected water to achieve a controlled degree of desuperheating of steam, so that steam is available for use at a lower temperature at a downstream location.

In accordance with one aspect of the invention, an on-line desuperheater unit of the general type described in the Bowlus U.S. Pat. No. 2,945,685 is so constructed as to be comprised of upper and lower main housing sections 44 and 10, which are joined together in the general region of the valve and valve guide structure by a permanently welded seal, as distinguished from a flanged and bolted-together construction heretofore utilized. In combination with the welded-up construction, novel arrangements are made for insertion of the valve and valve seat into the desuperheater unit, from the inlet opening, after welding together of the housing parts. Thus, as reflected in FIG. 1, the housing sections 44 and 10 are secured together by an annular weld 52 with a back-up ring 52a being positioned inside the housing wall directly inside the weld, to assist in aligning the housing parts and to prevent weld sputter from entering the housing. This is accomplished after installation of the orifice plate 22 and all of the valve guide structure mounted thereon, including the radially disposed ribs 30, the guide sleeve 29 and the U-shaped limiting element 32.

Installation of the valve and valve seat is accomplished, in accordance with the invention, by inserting the valve plug 28 axially through the inlet passage 50 and up into the guide sleeve 29, the friction plunger 35 being held in a partially retracted position by the stop pin 39 during this assembly operation. The valve plug 28 is then followed into the inlet passage 50 by the valve seat sleeve 21, which is inserted into the inlet opening until the flanged lower end 40 thereof seats firmly against the shoulder 41. The sleeve 21 may then be locked in its seated position by any suitable means. For most service conditions, the limited access required to the interior of the desuperheater unit jusitifies welding the sleeve 21 in place, it being possible later on to cut away the weld to disassemble the unit for servicing, if necessary.

To assist in the assembly of the valve and valve seat into the closed housing, the inlet passage 50 may be slightly oversize, and the diameter of the cylindrical valve plug 28 may be slightly smaller than the diameter of either the passage 50 (I.D.) or the sleeve 21 (O.D.).

In a practical construction of a desuperheater according to the Bowlus Patent, it is usually necessary to provide the joint in the area of the valve and valve guide structure, to enable this structure to be properly assembled within the desuperheater housing. However, the area of such a joint is a region of particularly high stress in a desuperheater unit, because the discharge of water into the steam in the vicinity of the valve and valve guide structure frequently does not result in immediate, perfect admixture and conversion to steam of the injected water under all service conditions. This can and frequently does lead to high thermal stresses in the vicinity of the valve and valve guide structure, as there may be significant and transient temperature variations between different areas of the housing wall. Where a bolted flange connection is used to join upper and lower housing parts in this immediate area, leakage of steam through the joint can be a problem when non-iniform thermal conditions occur. The specific construction of the desuperheater unit of the invention, providing for post welding insertion into the housing of the valve plug 28 and sleeve 21, enables the flanged coupling to be entirely eliminated from the assembly. The resulting unit is not only less expensive to construct, but is superior in performance.

In accordance with another aspect of the invention, the desuperheater housing, comprising the valve housing 10 and upper housing 44, is so constructed that the flow path of the steam-water, downstream of the valve, is converged back to the diameter of the downstream piping system in as short a distance as practicable. Heretofore, it has been considered necessary to provide a substantially elongated, enlarged diameter chamber of passage on the downstream side of the valve, in order to provide for desired flow and mixing characteristics of the steam and injected water. However, I have found that such an enlarged and elongated chamber increases the bulk and expense of the unit, as well as the pipe length desired for its installation, without significantly improving performance characteristics. Accordingly, pursuant to the present invention, the upper housing 44 is of a configuration to converge the flow of steam and water as quickly as practicable on a downstream side of the valve structure back to the diameter of the downstream piping, as reflected at 47. Thus, the valve housing 10 provides for an enlarged diameter flow path for the steam-water mixture around the outside of the guide sleeve 29. Thereafter, within a short distance, desirably less than the length of the valve guide structure itself, the walls of the upper housing 44 begin to converge relatively sharply. Within, say, about two lengths of the valve guide structure the flow path has been constricted substantially down to the diameter of the upstream piping 47.

In accordance with a specific aspect of the invention, a special form of backing ring 55, hereinafter sometimes referred to as a deflector ring, is provided in the neck area of the desuperheater housing, behind the weld junction 49. The deflector ring typically has greater than normal thickness and is provided with a forward bevel 56 on its upstream face and a back bevel 57 on its downstream face. In the operation of the unit, any unevaporated water clinging to and traveling along the walls of the housing will be deflected inwardly by the surfaces of the deflector ring 55, and then discharged into the turbulent flowing stream as it reaches the relatively sharp annular edge 58 at the downstream end of the backing ring.

Overall, the variable orifice desuperheater unit of the present invention represents a significant improvement over units heretofore known, including that of the original Bowlus U.S. Pat. No. 2,945,685 and subsequent improvements thereon. By eliminating the elongated, enlarged chamber on the downstream side of the valve structure, the overall height of the desuperheater unit is greatly reduced, achieving correspondingly significant reductions in manufacturing and shipping costs and greatly simplifying installation of the unit. This is able to be realized without loss of performance characteristics.

Additionally, by so constructing the desuperheater unit that the valve plug is inserted into the valve guide structure after closure of the main housing, it is made possible to secure the upper and lower housing sections by welding. Not only is this a more economical construction, but it is superior in performance in that nagging leakage problems, resulting from unequal thermal stressing of the housing walls in the general area of the valve, are avoided. These advantages are made possible by providing a somewhat oversized opening at the inlet side of the desuperheater housing, into which the valve plug may be inserted axially into the pre-installed valve guide structure. Insertion of the valve plug is followed by insertion of a sleeve-like member, forming the valve seat at its upper end. By means such as cooperating flange and shoulder 40–41, the insert sleeve 21 is positioned to precisely locate the valve seat and to accurately define the water atomizing aperture 42.

In addition to securing the insert sleeve 21 by welding, as illustrated, it is also possible to thread the insert into position by means of appropriately interengaging threads on the wall of the inlet passage 50 and of the outer surface of the insert flange 40. Likewise, the insert may be arranged to extend to and slightly beyond the sealing face 13 of the flange 12, to be tightly secured in position by the opposed flange 14 when the unit is installed in the line.

Although the general functioning of the variable orifice desuperheater unit of the present invention is generally similar to that of the Bowlus Patent, significant improvements are realized in the form of substantially reduced size, significantly lower manufacturing costs, and at the same time performance improvements in terms of avoiding leakage at the joint between upper and lower housing sections.

It should be understood, of course, that the specific form of the invention herein illustrated and described is intended to be representative only, as certain changes may be made therein without departing from the clear teachings of the disclosure. Accordingly, reference should be made to the following appended claims in determining the full scope of the invention.

I claim:

1. In a variable orifice steam desuperheater unit adapted for in-line operation in conjunction with steam piping upstream and downstream therefrom and of the type comprising a. upper and lower housing sections joined together to form a mixing chamber of enlarged diameter relative to the upstream and downstream piping,
b. said joined housing sections being adapted for connection to said upstream and downstream piping,
c. an orifice plate fixed in said lower housing and forming therewith an annular water injection chamber provided with an annular atomizing orifice,
d. said water inlet chamber being adapted for connection to water inlet piping, to supply water to said orifice,
e. an axially disposed valve guide structure mounted on the downstream side of said orifice plate,
f. a generally cylindrical valve plug slideably received in said guide structure, and
g. annular means forming a valve seat for cooperation with said valve plug in the region of said atomizing orifice, the improvement characterized by,
h. said lower housing being of unitary construction and extending from a region substantially below said orifice to a region substantially above said orifice,
i. said upper and lower housings being secured together by an annular housing weld in the general region of said valve and valve guide structure,
j. said lower housing having an inlet opening sufficiently large to accommodate axial insertion of said valve plug through said inlet opening and into said valve guide structure,
k. said inlet opening being adapted for connection with the upstream steam piping,
l. said annular means comprising a sleeve-like insert adapted for upward axial telescopic insertion into said inlet opening after insertion of said valve plug and being fixedly secured therein below said valve plug,
m. said sleeve-like insert forming an annular valve seat for cooperation with said valve plug.

2. A desuperheating unit according to claim 1, further characterized by
a. said means fixedly positioning said sleeve-like member comprising flange means on said sleeve-like member below its upper end and shouldered recess means on said lower housing.

3. A desuperheating unit according to claim 1, further characterized by
a. said upper housing being shaped to converge from said enlarged diameter substantially to the diameter of the downstream piping within a distance, above said valve guide structure, not significantly greater than twice the length thereof.

4. A desuperheating unit according to claim 1, further characterized by
a. deflector means in the upper end portion of said housing for deflecting inwardly water flowing on the walls of the housing,
b. said deflecting means forming a sharp annular edge at its downstream end for the discharge of water into the flowing steam.

5. A desuperheating unit according to claim 4, further characterized by
a. said housing having a welded joint in its upper outlet portion, and
b. said deflecting means compring a locking ring for said welded joint.

6. In a variable orifice steam desuperheater unit adapted for in-line operation in conjunction with steam piping upstream and downstream therefrom and of the type comprising
a. upper and lower housing sections joined together to form a mixing chamber of enlarged diameter relative to the upstream and downstream piping,
b. said joined housing sections being adapted for connection to said upstream and downstream piping,
c. an orifice plate fixed in said lower housing and forming therewith an annular water injection chamber provided with an annular atomizing orifice,
d. said water inlet chamber being adapted for connection to water inlet piping, to supply water to said orifice,
e. an axially disposed valve guide structure mounted on the downstream side of said orifice plate,
f. a generally cylindrical valve plug slideably received in said valve guide structure, and
g. annular means forming a valve seat for cooperation with said valve plug in the region of said atomizing orifice, the improvement characterized by
h. said lower housing being of unitary construction and extending from a region substantially below said orifice to a region substantially above said orifice,
i. said upper and lower housings being secured together by an annular housing weld in the general region of said valve and valve guide structure,
j. said lower housing having an inlet opening sufficiently large to accommodate axial insertion of said valve plug through said inlet opening and through said orifice and into said valve guide structure on the downstream side of said orifice plate,
k. said inlet opening being adapted for connection with the upstream steam piping,
l. said annular means comprising a sleeve-like insert adapted for upward axial telescopic insertion into said inlet opening after insertion of said valve plug and being fixedly secured therein below said valve plug,
m. said sleeve-like insert forming an annular valve seat at its upper end for cooperation with said valve plug,
n. said upper housing being of a configuration to constrict the internal diameter of said housing substantially to the diameter of the downstream piping substantially immediately above the upper end of said valve guide structure.

7. A desuperheating unit according to claim 6, further characterized by
a. said valve guide structure including means for limiting upward movement of the valve plug.

8. A desuperheating unit according to claim 6, further characterized by
a. said valve guide structure being mounted on and extending upward from said orifice plate, and
b. said upper housing being shaped to commence convergence of said enlarged diameter chamber within a distance above said valve guide structure not significantly exceeding the length thereof.

9. A desuperheating unit according to claim 8, further characterized by
a. said upper housing being shaped to converge said chamber substantially to the diameter of the downstream piping within a distance above said valve guide structure not significantly exceeding twice the length thereof.

10. A desuperheating unit according to claim 6, further characterized by a. said sleeve-like insert having an outwardly extending flange below its upper end, b. said lower housing having a shouldered recess for receiving and engaging said flange and thereby positively positioning said sleeve-like insert in said housing.

11. A desuperheating unit according to claim 6, further characterized by a. upper end portions of said sleeve-like insert forming the inner wall of said water injection chamber, and b. the upper end extremity of said sleeve-like insert forming part of said atomizing orifice.

* * * * *